United States Patent [19]

de Witt et al.

[11] Patent Number: 4,536,188

[45] Date of Patent: Aug. 20, 1985

[54] ALCOHOL COMPOSITIONS HAVING LUMINOUS FLAMES

[76] Inventors: Clinton J. de Witt, 610 Laurel Dr., Sacramento, Calif. 95825; Ron Reese, 4957 Buftwood Way, Sacramento, Calif. 95841

[21] Appl. No.: 636,281

[22] Filed: Jul. 31, 1984

[51] Int. Cl.[3] ..... C10L 1/30; C12F 5/00

[52] U.S. Cl. ..... 44/53; 44/59; 44/76; 252/366; 568/840; 568/851

[58] Field of Search ..... 44/53, 59, 76; 568/851

[56] References Cited

U.S. PATENT DOCUMENTS

| | | | |
|---|---|---|---|
| 621,338 | 3/1899 | Hempel | 44/53 |
| 1,684,686 | 9/1928 | Records | 44/53 |
| 1,712,030 | 5/1929 | Kyrides | 568/851 |
| 2,947,776 | 8/1960 | Chiras | 560/261 |
| 4,231,756 | 11/1980 | King | 44/53 |
| 4,327,230 | 4/1982 | Ackermann et al. | 568/851 |
| 4,369,043 | 1/1983 | Han | 44/53 |

FOREIGN PATENT DOCUMENTS

| | | | |
|---|---|---|---|
| 692850 | 6/1940 | Fed. Rep. of Germany | 44/53 |
| 23019 | 10/1903 | United Kingdom | 44/53 |

OTHER PUBLICATIONS

Lange "Handbook of Chemistry", 10th Ed., pp. 708, 709 and 1782–1785 (1961).

Schlesinger et al., "J. Am. Chem. Soc.", vol. 75 (1953), pp. 213–215.

Merk Index, 9th Ed. (1976), p. 9377.

*Primary Examiner*—J. E. Evans

*Attorney, Agent, or Firm*—Leonard Bloom

[57] ABSTRACT

Aliphatic alcohol compositions that burn with a luminous flame. Lower aliphatic alcohols such as methanol, ethanol, and propanol burn with an essentially colorless flame. This is particularly hazardous when such alcohols are used as fuels for racing cars or other motor vehicles. If such alcohol fuels ignite during, for example, refueling or following a collision, the fire may initially go unnoticed because of virtually colorless flames. The alcohol compositions of the invention contain alcohol-soluble metal compounds such as compounds of sodium, barium and boron, which impart luminosity to the flames of such alcohol compositions. The alcohol compositions of the invention find utility as fuels for racing cars or other motor vehicles, as fuels for alcohol stoves and in other applications where lack of a luminous flame creates a safety hazard.

2 Claims, No Drawings

ALCOHOL COMPOSITIONS HAVING LUMINOUS FLAMES

FIELD OF THE INVENTION

This invention relates broadly to alcohol fuel compositions that burn with luminous, or visible, flames. More particularly, it relates to aliphatic alcohol compositions containing alcohol-soluble metal compounds which impart luminosity, or visibility, to the flames of such alcohol compositions.

BACKGROUND OF THE INVENTION

Aliphatic alcohols, particularly the lower aliphatic alcohol, burn with virtually colorless flames. This property can be hazardous in the case of fire, especially when the fire occurs in daylight. Because of the virtually colorless flame, an alcohol fire may initially go unnoticed. This is particularly hazardous when a lower aliphatic alcohol is used as a fuel for racing cars or other motor vehicles or as a fuel for an alcohol stove.

Lower aliphatic alcohol, particularly methanol, are often used as fuels for racing cars and other motor vehicles. If this fuel ignites, for example, during refueling or in a collision, the fire may initially go unnoticed, particularly on a sunny day. There has long been a need to impart luminosity, or visibility, to the flames of alcoholic racing car/motor vehicle fuel compositions while not imparting undesirable characteristics to said fuel compositions. The additive must impart a high level of visibility to the flame while preferably being present at a very low concentration. It is generally undesirable to have high concentrations of additives which could build up engine wear.

Lower aliphatic alcohols are often used as fuels for stoves on small pleasure boats. If such fuels ignite on board a boat, it is imperative that the fire be immediately noticed and extinguished. Accordingly, there has been a long felt need for alcoholic stove fuels that burn with a visible flame. As with racing car/motor vehicle fuels, it is desirable that the additive for imparting visibility to the flame of the alcohol composition be effective at low concentrations so as not to build up residues in the stove.

Lower aliphatic alcohols are often used as solvents and thinners for paints, varnishes, and shellac. Again, there has long been a need from a safety point of view for imparting visibility to the flames of alcohols used as solvents and thinners.

SUMMARY OF THE INVENTION

This invention provides alcohol compositions that burn with a luminous, or visible, flame. The alcohol compositions of this invention find utility as racing car/motor vehicle fuels, as fuels for alcohol stoves, and as solvents and thinners for paints, varnishes, and shellac. The alcohol compositions of this invention thus overcome the hazard presented by untreated alcohols in that they burn with a readily detectable, visible flame.

It is, therefore, an object of this invention to provide alcohol compositions that burn with luminous, or visible, flames.

It is another object of this invention to provide alcoholic racing car/motor vehicle fuels that burn with visible flames.

It is yet another object of this invention to provide alcoholic fuel compositions for alcohol stoves that burn with visible flames.

Still another object of this invention is to provide alcoholic solvents and thinners that burn with luminous flames.

Yet another object of this invention is to provide a method of operating an internal combustion engine on an alcohol fuel composition that burns with a visible flame.

The foregoing and other objects are accomplished by the practice of this invention. Broadly, viewed in one of its principal aspects, this invention consists of an alcohol composition having a luminous flame comprising a major proportion of alcohol and a minor proportion of an alcohol-soluble metal compound that imparts a color to the flame when said alcohol compostion is burned.

The alcohol compostions of the invention may be used as fuels in internal combustion engines. The invention thus provides a method of operating an internal combustion engine consisting of burning in said engine an alcohol composition comprising a major proportion of alcohol and a minor proportion of an alcohol-soluble metal compound that imparts a color to the flame when said alcohol composition is burned.

The instant invention thus provides alcohol compositions that burn with visible flames. The alcohol compositions may employ any alcohol that burns with an essentially colorless flame. While the alcohol may be aliphatic or naphthenic, the preferred alcohols are lower aliphatic alcohols. the alcohol compositions contain an minor amount of an alcohol-soluble metal compound that imparts a color to the flame when the alcohol composition is burned. The alcohol compositions of this invention find utility as racing car/motor vehicle fuels, as fuels for alcohol stoves, and as solvents and thinnners for paints, varnishes, shellac, and the like. The fire hazard of the alcohol compositions of the invention is thus mitigated in that it is readily discernible when such compositions become ignited, thereby allowing for prompt extinction.

The nature and substance of the present invention as well as its objects and advantages will be more clearly perceived and fully understood by referring to the following detailed description and claims.

DESCRIPTION OF THE PREFERRED EMBODIMENTS

The alcohol compositions of this invention may employ any alcohol that burns with an essentially colorless flame. The alcohol may be aliphatic or naphthenic. However, lower aliphatic alcohols are preferred.

Suitable aliphatic alcohols contain from one to about twelve carbons. Examples of aliphatic alcohols useful in the practice of this invention are methanol, ethanol, and the various isomers of propanol, butanol, amyl alcohol, hexanol, octanol, decanol, and dodecanol. Methanol, ethanol, and propanol are preferred.

Suitable naphthenic alcohols contain three to about eight carbons in the ring and may contain various substituents on the ring. Examples of suitable naphthenic alcohols are cyclopropanol, cyclobutanol, cyclohexanol, and cycloheptanol.

The alcohol-soluble metal compounds that impart color to the flames of the alcohol compositions of the invention are compounds containing metals which give a characteristic color to flames. Examples of suitable metals are sodium, potassium, barium, and boron. Examples of suitable metal compounds for imparting color to alcohol compositions in which they are incorporated are barium hydroxide, trimethyl borate, potassium hydroxide, and sodium hydroxide.

The metal compounds must be sufficiently soluble in the alcohol to be present in high enough concentration to color the flame of the alcohol composition. Typically, only a small amount of the metal compound must be dissolved in the alcohol in order for its characteristic color to be imparted to the flame. Low concentration of the metal compound is an advantage in a number of applications of the alcohol compositions of the invention. For example, low concentrations of the metal compound are desirable in alcohol fuel compositions for racing cars and other motor vehicles where metal deposits which lower engine performance and cause excessive wear to be avoided. Similarly, alcohol fuel compositions for use in stoves will preferably not deposit metallic residues in stoves in which they are burned.

The concentration of the metal compounds in the alcohol compositions of the invention will vary depending on the alcohol and the metal compound. The concentration will broadly vary from about 0.5 weight percent to about 10.0 weight percent. The preferred concentration will vary depending upon the application.

The invention will be more clearly perceived and understood by referring to the following examples.

EXAMPLE 1

An alcohol composition according to the invention was prepared by dissolving trimethyl borate in methanol to yield compositions ranging from 0.5 to 10.0 weight percent of trimethyl borate. The alcohol composition burned with the characteristic green colored flame of boron compounds.

While specific embodiments of the present invention have been shown and described in detail to illustrate the inventive principles, it is to be understood that such showing and description have been offered only by way of example and not by way of limitation. Protection by Letters Patent of this invention in all its aspects as the same are set forth in the appended claims is sought to the broadest extent that the prior art allows.

We claim as our invention:

1. An alcohol composition intended as a fuel strictly for racing cars and comprising a major proportion of methanol and about 0.5 weight percent to about 10.0 weight percent of trimethyl borate that imparts a characteristic green colored flame when burned, thereby precluding a potentially hazardous situation from developing because of the otherwise virtually colorless flame associated with the burning of alcohol as a fuel in racing cars.

2. The alcohol composition of claim 1 comprising a major proportion of methanol and about 1.0 weight percent to about 8.0 weight percent of trimethyl borate.

* * * * *